US011946323B2

(12) United States Patent
Davison et al.

(10) Patent No.: US 11,946,323 B2
(45) Date of Patent: Apr. 2, 2024

(54) QUICK CONNECTION HYDRAULIC FRACTURING PLUG

(71) Applicant: Tally USA, LLC, Houston, TX (US)

(72) Inventors: Douglas Wayne Davison, Canyon Lake, TX (US); Shane Allen Davison, Tomball, TX (US)

(73) Assignee: Tally Production Systems, LLC, Houston, TX (US)

( * ) Notice: Subject to any disclaimer, the term of this patent is extended or adjusted under 35 U.S.C. 154(b) by 0 days.

(21) Appl. No.: 17/313,672

(22) Filed: May 6, 2021

(65) Prior Publication Data

US 2021/0348451 A1 Nov. 11, 2021

Related U.S. Application Data

(60) Provisional application No. 63/021,746, filed on May 8, 2020.

(51) Int. Cl.

| | |
|---|---|
| ***E21B 17/046*** | (2006.01) |
| ***E21B 17/02*** | (2006.01) |
| ***E21B 33/12*** | (2006.01) |
| ***E21B 43/26*** | (2006.01) |

(52) U.S. Cl.
CPC ..... *E21B 17/0465* (2020.05); *E21B 17/026* (2013.01); *E21B 33/12* (2013.01); *E21B 43/261* (2013.01)

(58) Field of Classification Search
CPC ..... E21B 17/046; E21B 17/0465
See application file for complete search history.

(56) References Cited

U.S. PATENT DOCUMENTS

2020/0056445 A1* 2/2020 Hardesty ..... E21B 33/128
2020/0392808 A1* 12/2020 Greenlee ..... E21B 33/134

* cited by examiner

*Primary Examiner* — Kristyn A Hall
(74) *Attorney, Agent, or Firm* — Park, Vaughan, Fleming & Dowler LLP

(57) ABSTRACT

A method and apparatus that provides a quick connection for a hydraulic fracturing plug to a drill string mandrel. In an embodiment, the hydraulic fracturing plug includes one or more pins for connecting to one or more corresponding connection points on the drill string mandrel. The connection points may include a first section and a second section, where the second section may include an end point for receiving a pin on the hydraulic fracturing plug. The connection between the hydraulic fracturing plug and the drill string mandrel may also include a master pin.

33 Claims, 10 Drawing Sheets

QUICK CONNECTION HYDRAULIC FRACTURING PLUG

CROSS-REFERENCE TO RELATED APPLICATIONS

The present application claims priority to U.S. Provisional Application 63/021,746, filed May 8, 2020, the entirety of which is incorporated by reference.

FIELD OF THE DISCLOSURE

Aspects of the disclosure relate to recovery of hydrocarbons from geological strata. More specifically, aspects of the disclosure relate to a quick connection hydraulic fracturing plug that is used in underground drilling and specifically with hydraulic fracturing operations.

BACKGROUND

The exploration of underground geological strata is an ever more challenging endeavor. As easy to reach pockets and strata of hydrocarbons are developed and depleted, operators are trying new ways to recover hydrocarbons from ever increasing depths or more remote locations. The increased depths of these hydrocarbon locations places each potential project's economics at risk. For example, in some aspects, the economics of drilling a wellbore are not positive if the actual drilling of the well exceeds the economic potential recovery of the deposit. For this reason, operators are extremely careful in selecting hydrocarbon recovery locations for development.

To help in the economics of well drilling, reducing the manpower and time to "make up" (attach) drill string components is one of the most lucrative areas to provide innovation. As the drilling rig attachment, called a "drill string", becomes longer, the attaching and breaking down of drill string components is one of the prime economic costs of a well.

A mandrel is a shaped tubular portion that may be transported along with the remainder of the drill string. Mandrels are generally used to establish a mechanical connection to the remainder of the drill string. Connections to mandrels, for example, is a common occurrence during the drilling of a well. These connections may be made, for example, during placement of a hydraulic fracturing ("frac") plug. In some wells, for example, a slurry of sand and water is pumped downhole to a specific area of the wellbore. The slurry is kept under very high pressure such that the rock surrounding the wellbore is broken by the high pressure. Hydrocarbons within the near vicinity of the wellbore, for example in oil rich shale, exit the formation and penetrate the wellbore once the high pressure on the geological strata is released. The sand constituents of the slurry prop open the rock that has been fractured and are generally called "proppants". The entire procedure, called hydraulic fracturing, is becoming increasingly common in shale formations, to draw out the hydrocarbons trapped from the strata.

The mechanical connections made to a mandrel, for example for a hydraulic fracturing plug, in conventional apparatus, takes significant time to establish. Conventional hydraulic fracturing plugs are provided with a pre-drilled hole into which a series of pins are inserted. Such conventional apparatus use at least four pins for insertion by an operator to establish a positive connection between the hydraulic fracturing plug and the mandrel. The pins are placed through a tension mandrel and into the mandrel of the frac plug. The pins are then rotated to lock the components together.

Such conventional connections between hydraulic fracturing plugs and tension mandrels are unreliable as workers are rushed to establish the connection. The number of screws/pins inserted between the two components takes excessive time. If the screws/pins are not properly installed or are left out altogether, then the tension mandrel can separate from the hydraulic fracturing plug mandrel, causing either an environmental or safety concern.

There is a need to provide apparatus and methods that are easier to operate than conventional apparatus and methods wherein tension mandrels can connect to hydraulic fracturing plug mandrels in a more positive manner.

There is a further need to provide apparatus and methods that do not have the drawbacks discussed above, such as worker safety ramifications and environmental concerns if separation occurs within a wellbore.

There is a still further need to reduce economic costs associated with operations and apparatus described above with conventional tools.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a method of connecting a hydraulic fracturing plug to a mandrel of a drill string is disclosed. The method may comprise providing a mandrel of the hydraulic fracturing plug, the mandrel of the hydraulic fracturing plug having a set of pre-installed shear pins. The method may further comprise inserting a mating collar of the mandrel of the drill string over the pre-installed shear pins. The method may further comprise rotating the mating collar of the mandrel of the drill string such that the preinstalled shear pins contact an end position of a pin track. The method may further comprise inserting a master shear pin through at least a portion of the mating collar of the mandrel and the mandrel of the hydraulic fracturing plug. The method may also include a preinstalled spring loaded plunger that contacts the clutch on the top of plug head acting as the master shear pin to not allow the plug to rotate off the pin track.

In another example embodiment of the disclosure, a method of connecting a hydraulic fracturing plug to a mandrel of a drill string is disclosed. The method may comprise providing a mandrel of the hydraulic fracturing plug, the mandrel of the hydraulic fracturing plug having a set of pre-installed shear pins and inserting a mating collar of the mandrel of the drill string over the pre-installed shear pins. The method may also comprise rotating the mandrel of the hydraulic fracturing plug such that the pre-installed shear pins contact an end position of a pin track. The method may further comprise inserting a master shear pin through at least a portion of the mating collar of the mandrel and the mandrel of the hydraulic fracturing plug. The method may also include a preinstalled spring loaded plunger that contacts the clutch on the top of plug head acting as the master shear pin to not allow the plug to rotate off a pin track.

In another embodiment, an arrangement is disclosed. The arrangement may comprise a hydraulic fracturing plug with a body which has a gripping surface. The arrangement may also comprise a collar attached to the body, the collar having a single master shear pin hole within the body. The arrangement may further comprise a set of shear pins placed at least partially within the collar.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments.

Figure 1:
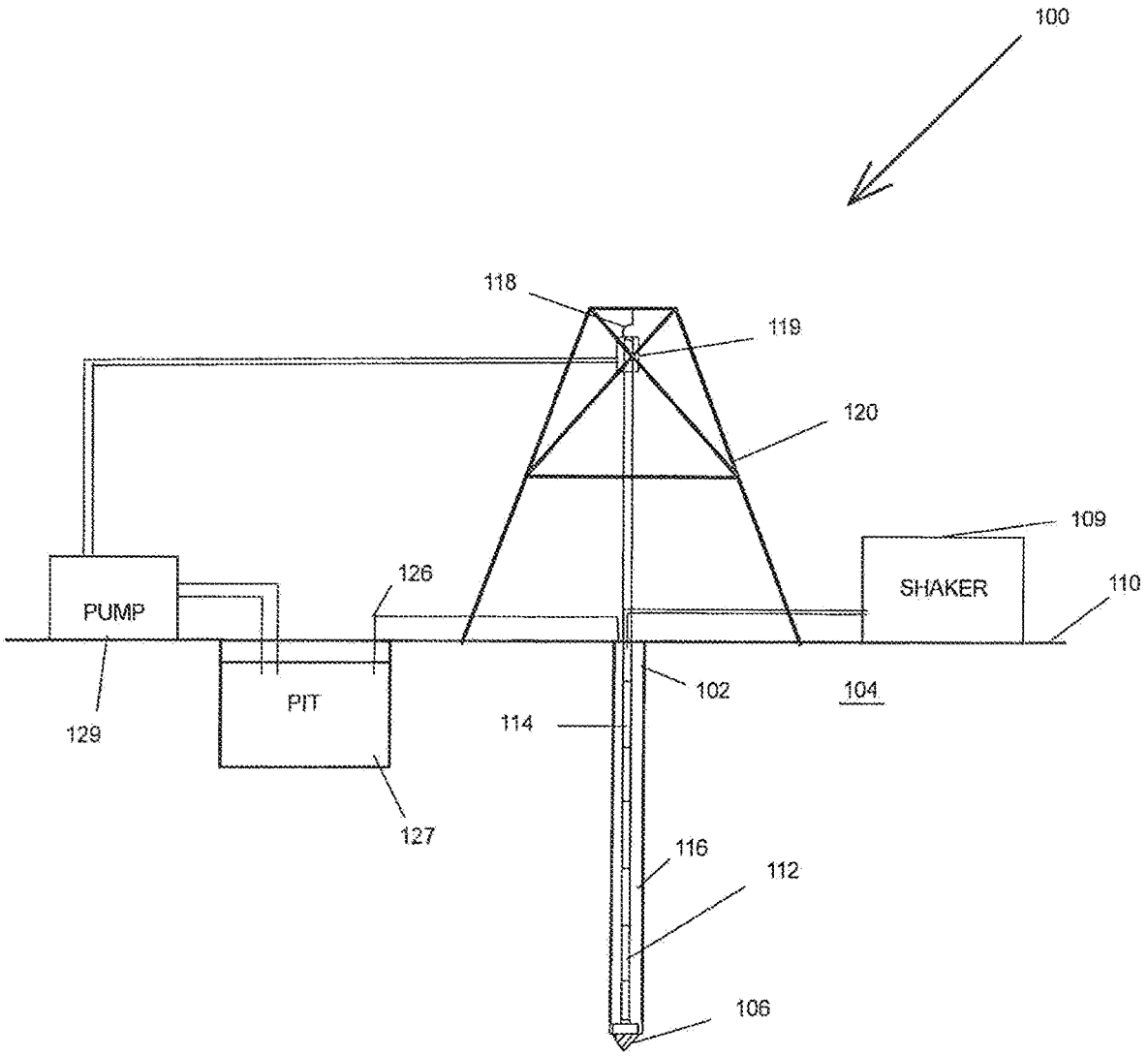
FIG. 1 is a drill rig performing a hydrocarbon recovery operation in one aspect of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and shall not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure relate to a quick connection hydraulic fracturing plug. The quick connection hydraulic fracturing plug allows for quick installation of the hydraulic fracturing plug to a mandrel of a drill string. While conventional apparatus require numerous shear pins to be installed between a hydraulic fracturing plug and a mandrel, aspects of the present disclosure resolve these problems by providing a simplified but robust connection scheme.

Aspects of the disclosure allow for an "L" shaped track placed in the mandrel of the drill string. A preinstalled set of pins of the quick connection hydraulic fracturing plug interface with the "L" shaped track allowing for quick connect and disconnect of the hydraulic fracturing plug. First, the process of drilling a wellbore is described to acquaint the reader with the process of wellbore drilling. After this discussion, the particular components and methods of aspects of the disclosure are presented.

Referring to FIG. 1, a drilling rig 100 is illustrated. The purpose of the drilling rig 100 is to recover hydrocarbons located beneath the surface 110. Different stratum 104 may be encountered during the creation of a wellbore 102. In FIG. 1, a single stratum 104 layer is provided. As will be understood, multiple layers of stratum 104 may be encountered. In embodiments, the stratum 104 may be horizontal layers. In other embodiments, the stratum 104 may be vertically configured. In still further embodiments, the stratum 104 may have both horizontal and vertical layers. The stratum 104 may include pockets of material. In some embodiments, these pockets of material may be rock, liquid or gas, wherein some of these materials may contain hydrocarbons that may be recovered. Stratum 104 beneath the surface 110 may be varied in composition, and may include sand, clay, silt, rock and/or combinations of these. Operators, therefore, need to assess the composition of the stratum 104 in order to maximize penetration of a drill bit 106 that will be used in the drilling process. The wellbore 102 is formed within the stratum 104 by a drill bit 106 as the drill bit is forced into the earth through actions of the drilling rig 100. In embodiments, the drill bit 106 is rotated such that contact between the drill bit 106 and the stratum 104 causes portions ("cuttings") of the stratum 104 to be loosened at the bottom of the wellbore 102. Differing types of drill bits 106 may be used to penetrate different types of stratum 104. The types of stratum 104 encountered, therefore, are an important characteristic for operators. The types of drill bits 106 may vary widely. In some embodiments polycrystalline diamond compact ("PDC") drill bits may be used. In other embodiments, roller cone bits, diamond impregnated or hammer bits may be used. In embodiments, during the drilling process, vibration may be placed upon the drill bit 106 to aid in the breaking of stratum 104 that are encountered by the drill bit 106. Such vibration may increase the overall rate of penetration ("ROP"), increasing the efficiency of the drilling operations. Cuttings developed during the rotation of the drill bit 106 may be removed from the wellbore 102 by injecting a liquid into the wellbore 102 that travels down the wellbore 102, exits out the drill bit 106 and flushes the cuttings up an annulus that is created during the drilling process.

As the wellbore 102 penetrates further into the stratum 104, operators may add portions of drill string pipe 114 to form a drill string 112. As illustrated in FIG. 1, the drill string 112 may extend into the stratum 104 in a vertical orientation. In other embodiments, the drill string 112 and the wellbore 102 may deviate from a vertical orientation. In some embodiments, the wellbore 102 may be drilled in certain sections in a horizontal direction, parallel with the surface 110.

The drill bit 106 is larger in diameter than the drill string 112 such that when the drill bit 106 produces the hole for the wellbore 102, an annular space is created between the drill string 112 and the inside face of the wellbore 102. As described above, this annular space provides a pathway for removal of cuttings from the wellbore 102. Drilling fluids include water and specialty chemicals to aid in the formation of the wellbore 102. Other additives, such as defoamers, corrosion inhibitors, alkalinity control, bactericides, emulsifiers, wetting agents, filtration reducers, flocculants, foaming agents, lubricants, pipe-freeing agents, scale inhibitors, scavengers, surfactants, temperature stabilizers, scale inhibitors, thinners, dispersants, tracers, viscosifiers, and wetting agents may be added.

The drilling fluids may be stored in a pit 127 located at the drill site. The pit 127 may have a liner to prevent the drilling fluids from entering surface groundwater and/or contacting surface soils. In other embodiments, the drilling fluids may be stored in a tank alleviating the need for a pit 127. The pit 127 may have a recirculation line 126 that connects the pit 127 to a shaker 109 that is configured to process the drilling fluid after progressing from the downhole environment.

Drilling fluid from the pit 127 is pumped by a mud pump 129 that is connected to a swivel 119. The drill string 112 is suspended by a drive 118 from a derrick 120. In the illustrated embodiment, the drive 118 may be a unit that sits atop the drill string 112 and is known in the industry as a "top drive". The top drive 118 is configured to provide the rotational motion of the drill string 112 and attached drill bit 106. Although the drill string 112 is illustrated as being rotated by a top drive 118, other configurations are possible. A rotary drive located at or near the surface 110 may be used by operators to provide the rotational force. Power for the rotary drive or the top drive 118 may be provided by diesel generators.

Drilling fluid is provided to the drill string 112 through a swivel 119 suspended by the derrick 120. The drilling fluid exits the drill string 112 at the drill bit 106 and has several functions in the drilling process. The drilling fluid is used to cool the drill bit 106 and remove the cuttings generated by the drill bit 106. The drilling fluid with the loosened cuttings enters the annular area outside of the drill string 112 and travels up the wellbore 102 to a shaker 109. The drilling fluid provides further information on the stratum 104 being encountered and may be tested with a viscometer, for example, to determine formation properties. Such formation properties allow engineers the ability to determine if drilling should proceed or terminate.

The shaker 109 is configured to separate the cuttings from the drilling fluid. The cuttings, after separation, may be analyzed by operators to determine if the stratum 104 currently being penetrated has hydrocarbons stored within the stratum 104 level that is currently being penetrated by the drill bit 106. The drilling fluid is then recirculated to the pit 127 through the recirculation line 126. The shaker 109 separates the cuttings from the drilling fluid by providing an acceleration of the fluid onto a screening surface. As will be understood, the shaker 109 may provide a linear or cylindrical acceleration for the materials being processed through the shaker 109. In embodiments, the shaker 109 may be configured with one running speed. In other embodiments, the shaker 109 may be configured with multiple operating speeds. In embodiments, the shaker 109 may operate at multiple operating speeds. The shaker 109 may be configured with a low speed setting of 6.5 "g" and a high speed setting of 7.5 "g", where "g" is defined as the acceleration of gravity, Large cuttings are trapped on the screens, while the drilling fluid passes through the screens and is captured for reuse. Tests may be taken of the drilling fluid after passing through the shaker 109 to determine if the drilling fluid is adequate to reuse. Viscometers may be used to perform such testing.

As will be understood, smaller cuttings may pass entirely through the screens of the shaker 109 such that the fluids may include many smaller size cuttings. The overall quality of the drilling fluid, therefore, may be compromised by such smaller cuttings. The drilling fluid may be, as example, water based, oil based or synthetic based types of fluids. The fluids provide several functions, such as the capability to suspend and release cuttings in the fluid flow, the control of formation pressures (pressures downhole), maintain wellbore stability, minimize formation damage, cool, lubricate and support the bit and drilling assembly, transmission of energy to tools and the bit, control corrosion and facilitate completion of the wellbore. In embodiments, the drilling fluids may also minimize environmental impact of the well construction process.

Figure 2:
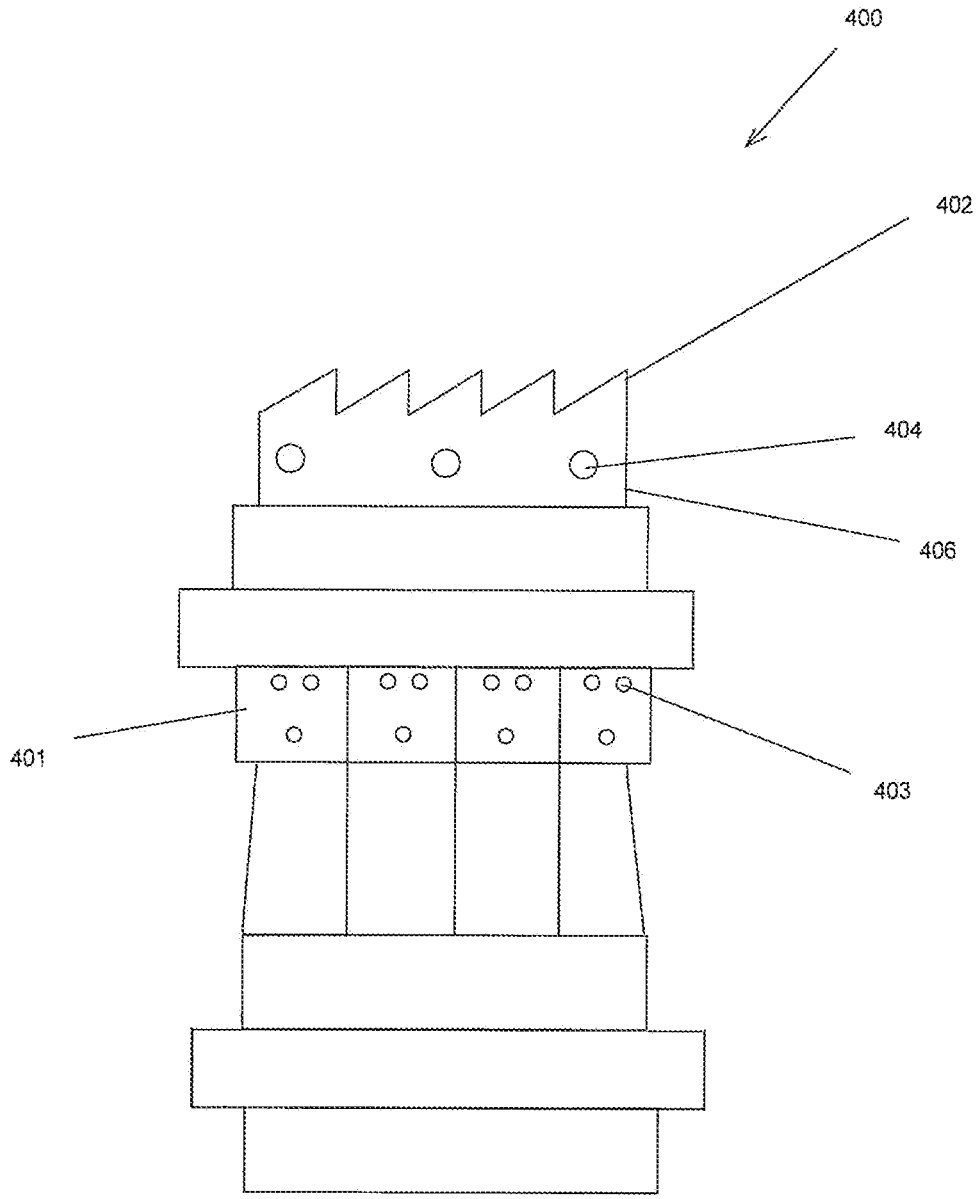
FIG. 2 is a side elevational view of one non-limiting example embodiment of the disclosure of a hydraulic fracturing plug with preinstalled shear screw within the collar of the hydraulic fracturing plug.

Referring to FIG. 2, a side elevational view of a hydraulic fracturing plug 400, in one embodiment of the disclosure, is illustrated. The hydraulic fracturing plug 400 may be provided with an edged surface 402 to intersect with a mating surface present in a drill string 112. In order to connect the hydraulic fracturing plug 400 with the drill string 112, a set of shear pins 404 are provided in a collar 406 of the hydraulic fracturing plug 400. The set of shear pins 404 may vary in number according to the amount of shear needed to be resisted. In the illustrated embodiment, five (5) shear pins 404 are installed around the periphery of the collar 406. More or less numbers of shear pins 404 may be used. The hydraulic fracturing plug 400 is configured with a gripping surface such that the hydraulic fracturing plug 400 may be placed within a casing string to hold pressure. The gripping surface 401 may be expandable in some embodiments. A set of contact points 403 may also be provided on the exterior of the hydraulic fracturing plug 400 such that any contact between the hydraulic fracturing plug 400 and an interior surface of a casing section occurs at these points. The set of contact points 403 may be made of a material, such as stainless steel. As will be understood, the hydraulic fracturing plug 400 may be expanded such that portions of the hydraulic fracturing plug 400 other than the contact points 403 also contact an interior surface of the inner diameter of a casing section to provide for a leak tight seal.

Figure 3:
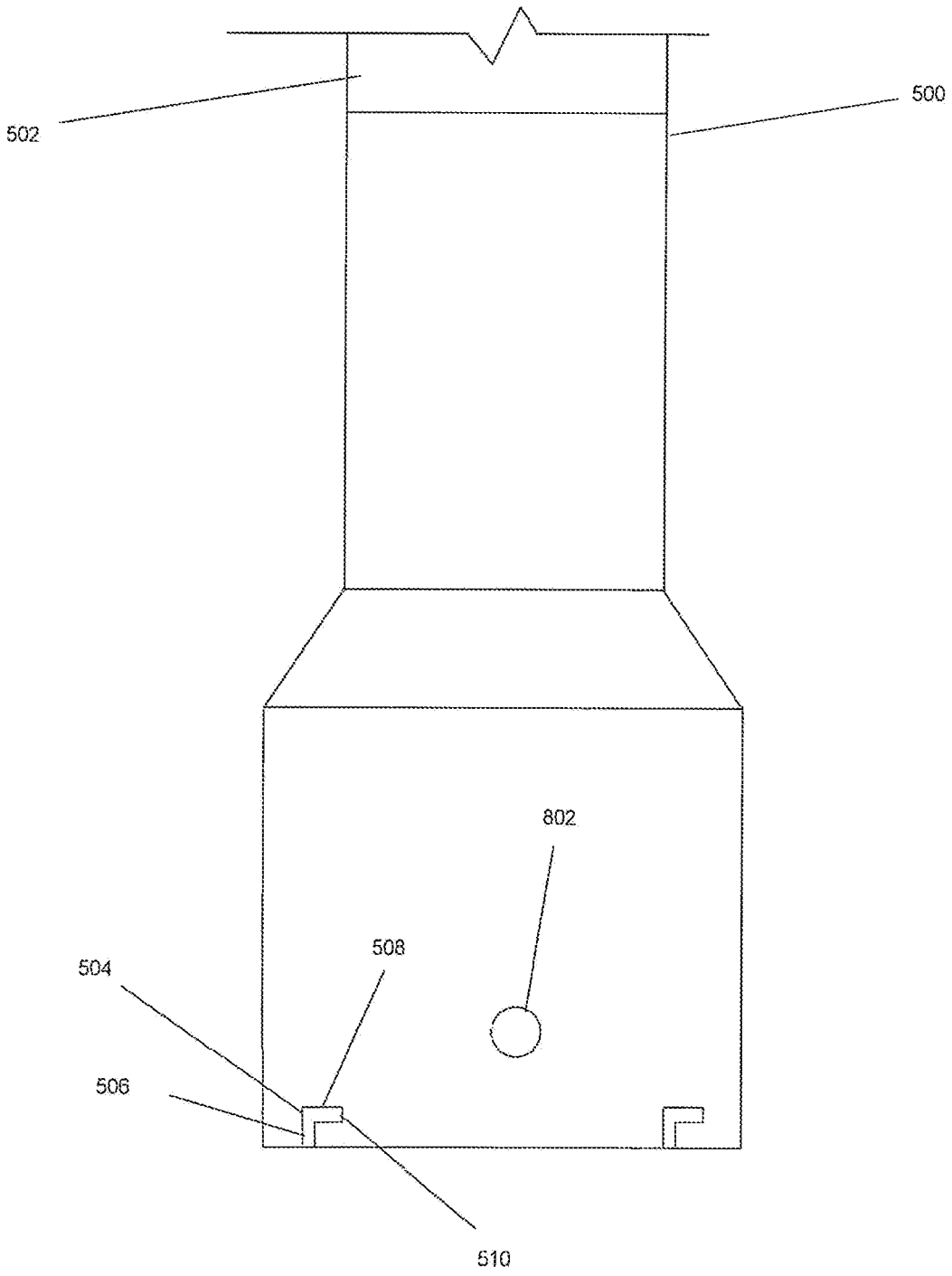
FIG. 3 is a mating section of a mandrel that connects to the preinstalled shear pins of FIG. 2.

Referring to FIG. 3, a mandrel 500 is illustrated, wherein a connection is desired to be made to the mandrel 500. The mandrel 500 has an "L" shaped set of pin tracks 504 that have a first section 506 and a second section 508. At the end of the second section 508 is an end position 510. The pin tracks 504 are created such that the distance across the pin track 504 corresponds to a diameter of each of the set of shear pins 404 of FIG. 2. The configuration allows for the set of shear pins 404 to be quickly inserted into each of the pin tracks 504, minimizing connection time between the hydraulic fracturing plug 400 and the mandrel 500.

Figure 4:
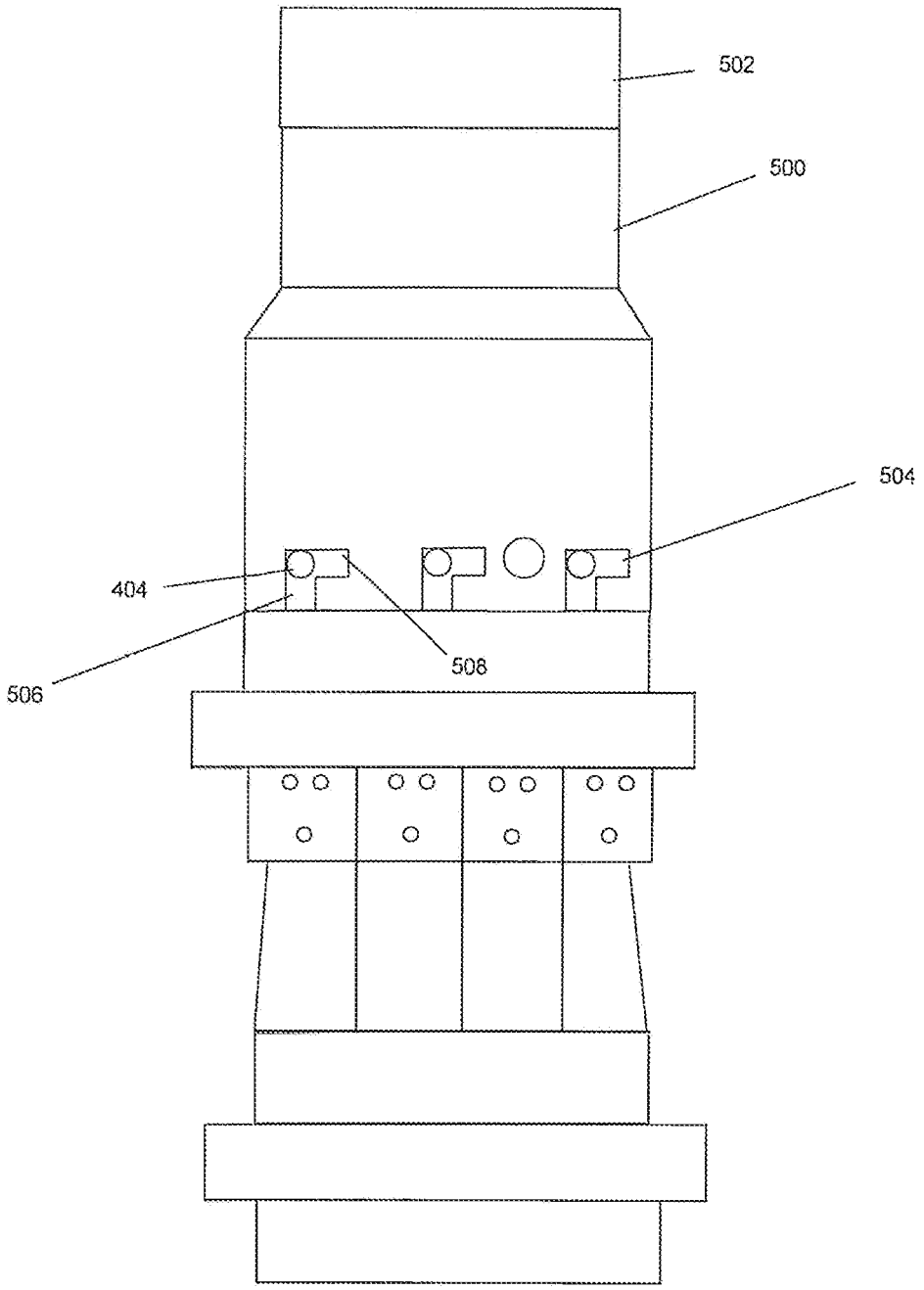
FIG. 4 is a side elevational view of the mating section of the mandrel with the preinstalled shear pins of FIG. 3 partially installed in the mating section.

Referring to FIG. 4, a first insertion of the set of shear pins 404 has occurred into the mandrel 500 of the drill string 502. One of the shear pins 404 is fully inserted into a first section 506 of the "L" shaped set of pin tracks 504. As will be understood, all of the set of shear pins 404 are placed in a similar position within their respective "L" shaped set of pin tracks 504.

Figure 5:
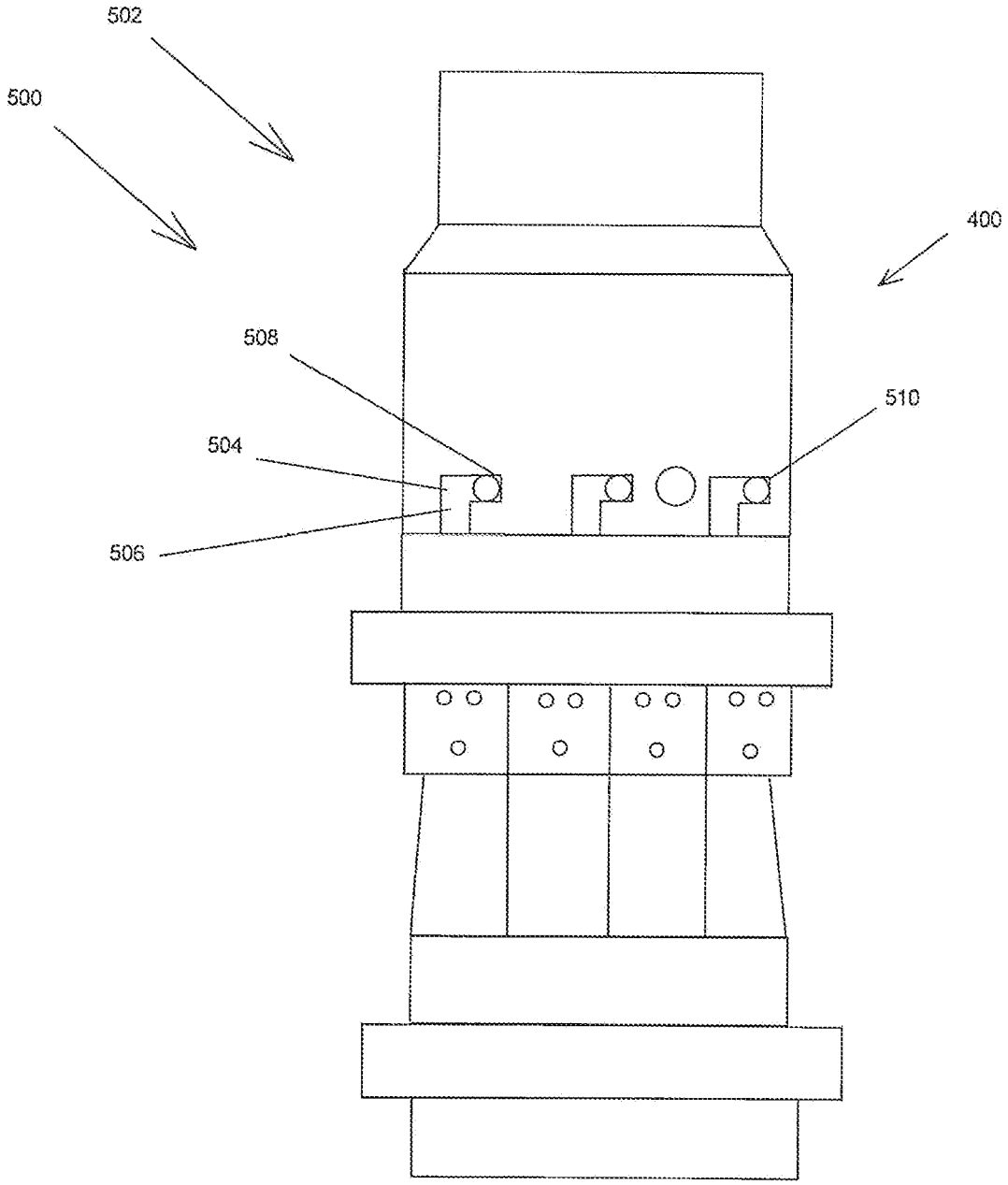
FIG. 5 is a side elevational view of the mating section of the mandrel with the preinstalled shear pins of FIG. 4 fully installed in the mating section.

Referring to FIG. 5, a twisting motion has occurred such that the set of shear pins 404 has entered the second section 508 of the "L" shaped set of pin tracks 504. The set of shear pins 404 is placed in an end position 510 in the set of pin tracks 504. The twisting or rotation may occur through rotation of the hydraulic fracturing plug 400 or through rotation of the mandrel 500 of the drill string 502. As will be understood, either the hydraulic fracturing plug 400 may be held in place while the drill string 502 is rotated, or the drill string 502 may be held in place and the hydraulic fracturing plug 400 rotated.

Figure 6:
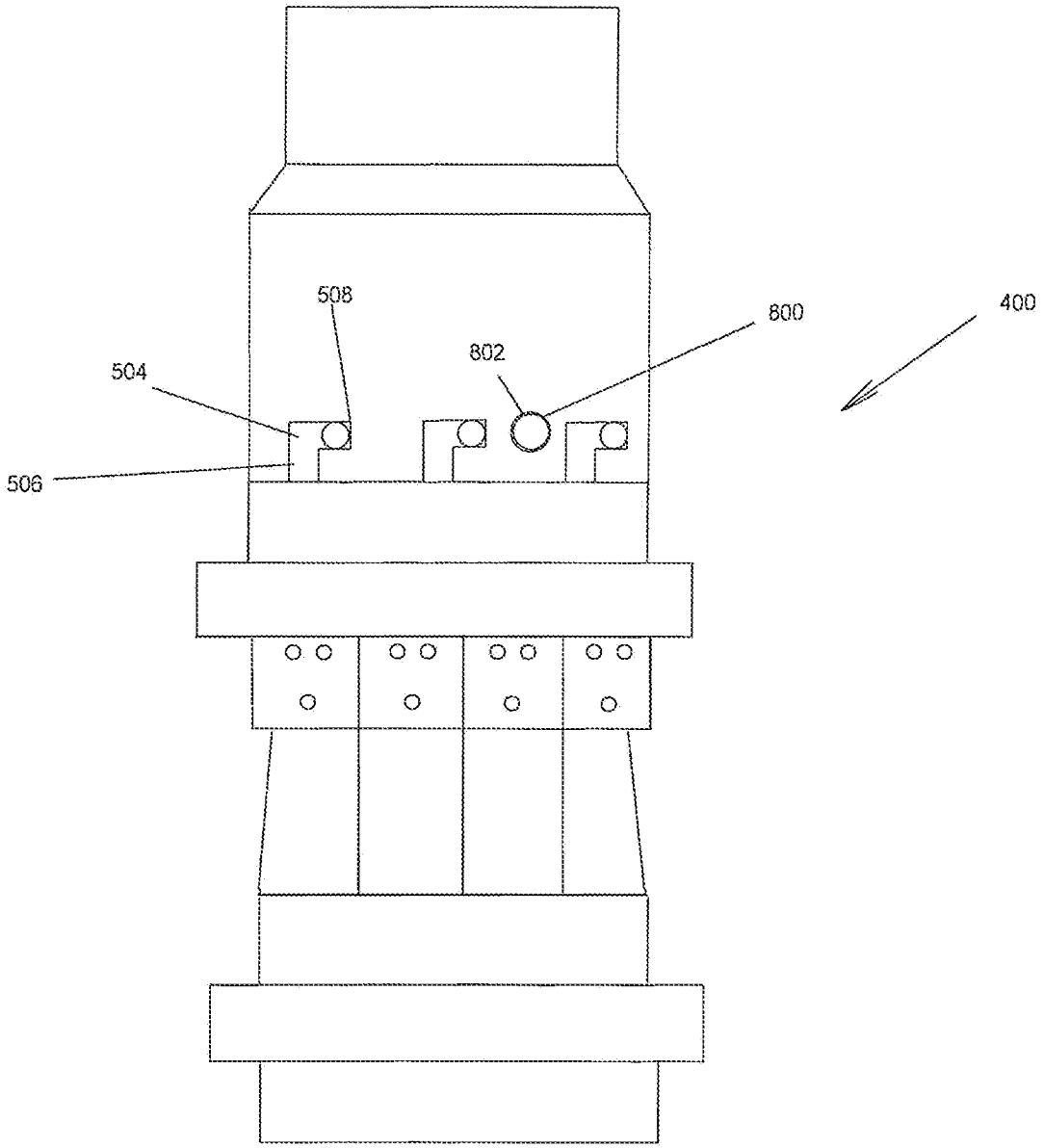
FIG. 6 is a side elevational view of the mating section of the mandrel with the preinstalled shear pins of FIG. 2 with a master shear screw installed.

Referring to FIG. 6, a master shear pin 800 is inserted into a shear pin hole 802 that travels through the mandrel 500 of the drill string 502 and at least partially though the collar 406 of the hydraulic fracturing plug 400. (See FIG. 2). The master shear pin 800 may be lubricated, in some embodiments, if desired, to make insertion of the master shear pin 800 into the shear pin hole 802 easier. In some embodiments, the master shear pin 800 arrangement may be altered. Numerous master shear pins 800 may be used or may be omitted altogether.

In the embodiments described, metallic materials may be used in the construction of the various components. For example, stainless steel materials may be used for the set of shear pins 404. The hydraulic fracturing plug 400 may be made of various materials, such as composite materials and metallic materials.

Figure 7:
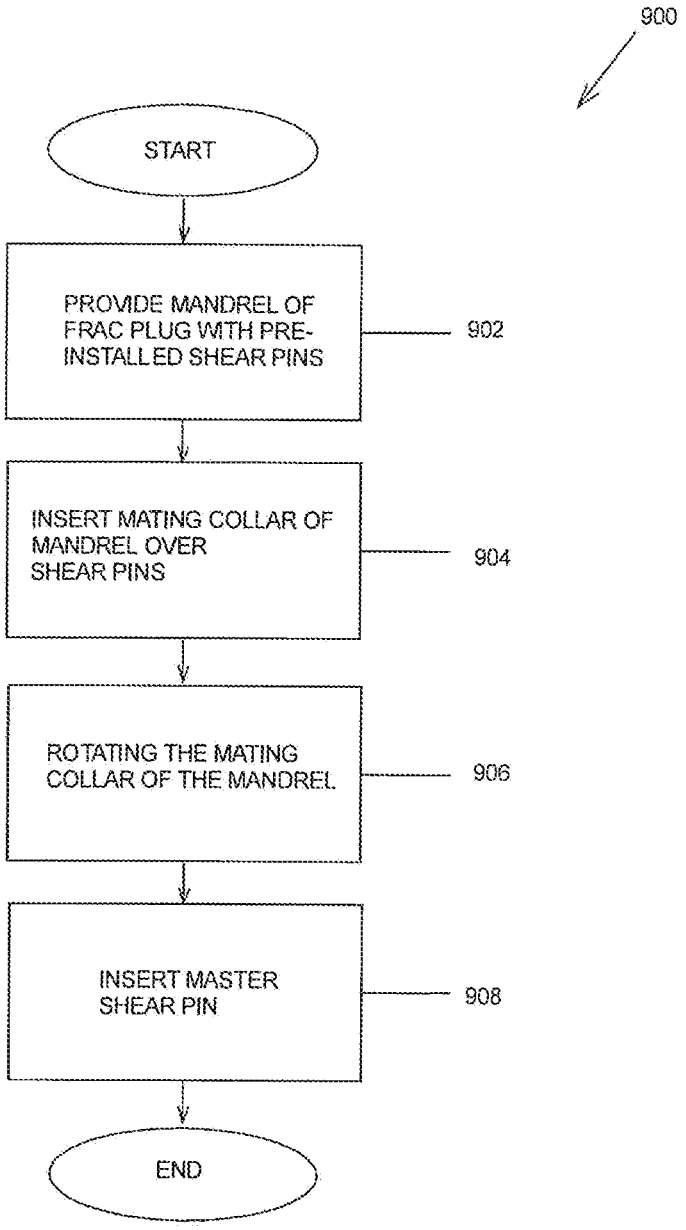
FIG. 7 is a method of connecting a mandrel of the hydraulic fracturing plug to a tension mandrel in accordance with one example embodiment of the disclosure.

Referring to FIG. 7, a method 900 of connecting a hydraulic fracturing plug to a mandrel of a drill string is disclosed. The method may comprise, at 902, providing a mandrel of the hydraulic fracturing plug, the mandrel of the hydraulic fracturing plug having a set of pre-installed shear pins. The method may also provide, at 904, inserting a mating collar of the mandrel of the drill string over the pre-installed shear pins. The method may also provide, at 906, rotating the mating collar of the mandrel of the drill string such that the pre-installed shear pins contact an end position of a pin track. The method may also provide, at 908, inserting a master shear pin through at least a portion of the mating collar of the mandrel and the mandrel of the hydraulic fracturing plug.

Figure 8:
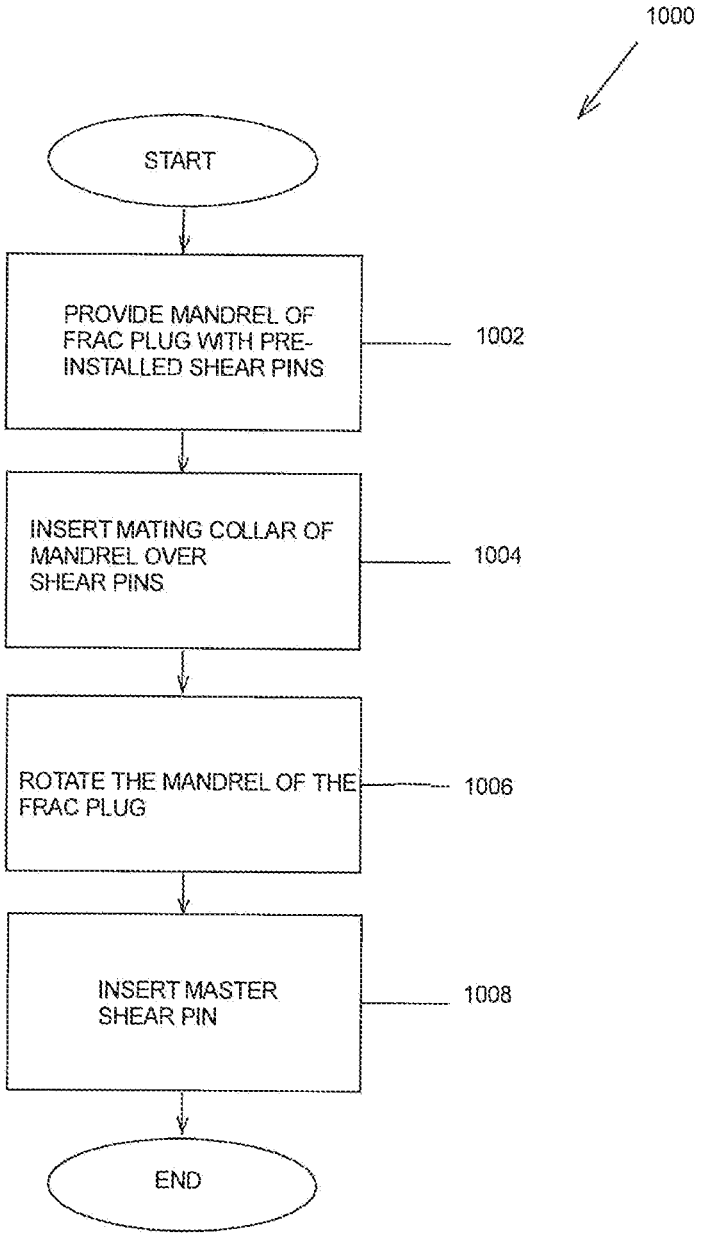
FIG. 8 is a second method of connecting a mandrel of the hydraulic fracturing plug to a tension mandrel in accordance with another example of the disclosure.

Referring to FIG. 8, a method 1000 of connecting a hydraulic fracturing plug to a mandrel of a drill string is disclosed. The method 1000 may comprise, at 1002, providing a mandrel of the hydraulic fracturing plug, the mandrel of the hydraulic fracturing plug having a set of pre-installed shear pins. The method may also provide for, at 1004, inserting a mating collar of the mandrel of the drill string over the pre-installed shear pins of the mandrel of the hydraulic fracturing plug. At 1006, the method may also provide for rotating the mandrel of the hydraulic fracturing plug such that the pre-installed shear pins contact an end position of a pin track. At 1008, the method may also provide for inserting a master shear pin through at least a portion of the mating collar of the mandrel and the mandrel of the hydraulic fracturing plug. As will be understood, alternative methods are envisioned wherein either the mandrel of the hydraulic fracturing plug or the drill string may be rotated to make the connection.

Figure 9:
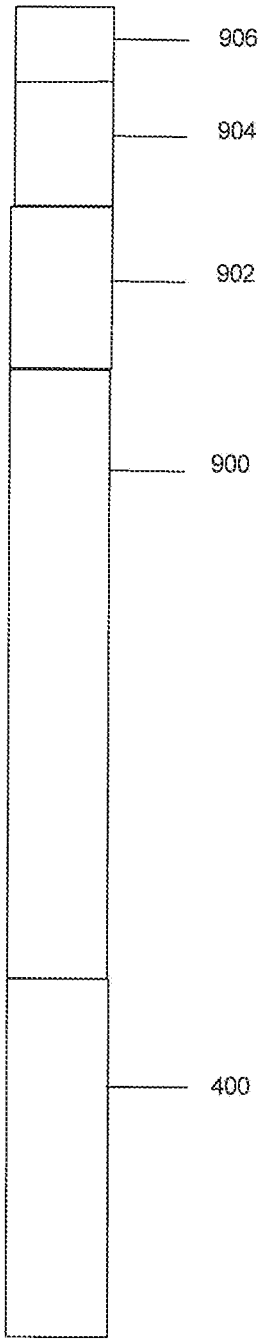
FIG. 9 is a side elevational drawing of a wireline configuration illustrating use of a wireline adapter kit to connect the quick connection hydraulic fracturing plug to the wireline system.

In embodiments, the methods and apparatus are equally applicable for use on a wireline for lowering the hydraulic fracturing plug and setting. As such, description related to a "drill string" should not be considered limiting. In a sample wireline application, a wireline adapter kit (WLAK) 900 may be used to connect the hydraulic fracturing plug to the wireline unit. Above the wireline adapter kit, a setting tool 902 may be used. The setting tool may be preceded by a firing head 904 and a single or set of guns 906. Such a configuration is illustrated in FIG. 9.

Figure 10:
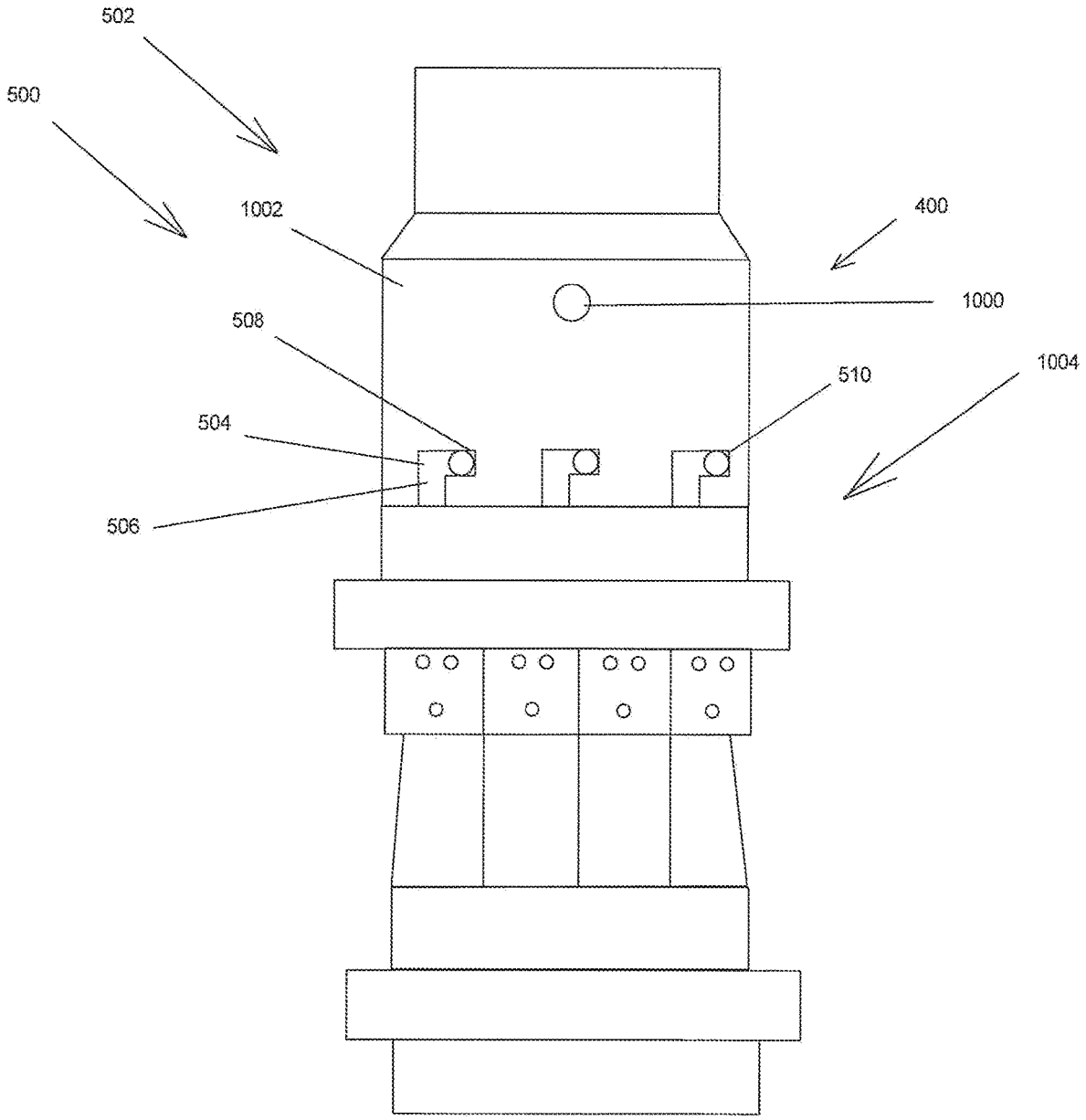
FIG. 10 is a side elevational view of a preinstalled spring loaded plunger that contacts a clutch on a top of a plug head.

Referring to FIG. 10, an alternative arrangement is illustrated. In this arrangement a preinstalled spring loaded plunger 1000 may be used to contact a clutch 1002 on a top of plug head 1004. This arrangement may be used instead of the connection arrangements using a master pin. The pre-installed spring loaded plunger 1000 allows for positive connection between the components and the hydraulic fracturing plug and a wireline adapter kit such that if an operator were to misplace or forget to install a master pin in previous embodiments, the hydraulic fracturing plug is not allowed to rotate off of the pin track.

In one example embodiment, a method of connecting a hydraulic fracturing plug to a mandrel of a drill string is disclosed. The method may comprise providing a mandrel of the hydraulic fracturing plug, the mandrel of the hydraulic fracturing plug having a set of pre-installed shear pins. The method may further comprise inserting a mating collar of the mandrel of the drill string over the pre-installed shear pins. The method may further comprise rotating the mating collar of the mandrel of the drill string such that the pre-installed shear pins contact an end position of a pin track. The method may further comprise one of inserting a master shear pin through at least a portion of the mating collar of the mandrel and the mandrel of the hydraulic fracturing plug and using a preloaded spring pin for connecting the mating collar of the mandrel and the mandrel of the hydraulic fracturing plug.

In another example embodiment of the disclosure, the method may be performed wherein the inserting the master shear pin further comprises rotating the master shear pin.

In another example embodiment of the disclosure, the method may further comprise greasing the master shear pin prior to inserting the portion of the mating collar of the mandrel and the mandrel of the hydraulic fracturing plug.

In another example embodiment of the disclosure, the method may further comprise gripping the mandrel of the hydraulic fracturing plug with an arrangement to prevent rotation prior to inserting the mating collar of the mandrel of the drill string over the pre-installed shear pins.

In another example embodiment of the disclosure, a method of connecting a hydraulic fracturing plug to a mandrel of a drill string is disclosed. The method may comprise providing a mandrel of the hydraulic fracturing plug, the mandrel of the hydraulic fracturing plug having a set of pre-installed shear pins and inserting a mating collar of the mandrel of the drill string over the pre-installed shear pins. The method may also comprise rotating the mandrel of the hydraulic fracturing plug such that the pre-installed shear pins contact an end position of a pin track. The method may further comprise one of inserting a master shear pin through at least a portion of the mating collar of the mandrel and the mandrel of the hydraulic fracturing plug and using a preloaded spring pin for connecting the mating collar of the mandrel and the mandrel of the hydraulic fracturing plug.

In another embodiment, the method may be performed wherein the inserting the master shear pin further comprises rotating the master shear pin.

In another embodiment, the method may further comprise greasing the master shear pin prior to inserting the portion of the mating collar of the mandrel and the mandrel of the hydraulic fracturing plug.

In another embodiment, the method may further comprise gripping the mandrel of the drill string with an arrangement to prevent rotation prior to inserting the mating collar of the mandrel of the drill string over the pre-installed shear pins.

In another embodiment, an arrangement is disclosed. The arrangement may comprise a hydraulic fracturing plug with a body which has a gripping surface. The arrangement may also comprise a collar attached to the body, the collar having a single master shear pin hole within the body. The arrangement may further comprise a set of shear pins placed at least partially within the collar.

In another embodiment, the arrangement may be configured wherein the collar attached to the body has an edged surface.

In another embodiment, the arrangement may further comprise a mandrel for a drill string, the mandrel having a track wherein the set of shear pins is configured to be captured by the track, and a master shear pin connecting the mandrel for the drill string to the hydraulic fracturing plug.

In another embodiment, the arrangement may be configured wherein the track has a first section and a second section.

In another embodiment, the arrangement may be configured wherein the first section is perpendicular to the second section.

In another embodiment, the arrangement may be configured wherein the set of shear pins is configured from stainless steel.

In another embodiment, the arrangement may further comprise an edged surface on at least a portion of the collar of the hydraulic fracturing plug and a mating surface for the mandrel for the drill string, the mating surface for the mandrel configured to interface with the edged surface of the hydraulic fracturing plug.

In another embodiment, the arrangement may be configured wherein the set of shear pins is a set of five pins.

In another embodiment, the arrangement may be configured wherein the shear pins are equidistantly placed around a periphery of the collar.

In another embodiment, the arrangement may be configured wherein the gripping surface has a set of contact points to connect the hydraulic fracturing plug to an interior surface of a casing section.

In another embodiment, the arrangement may be configured wherein the set of contact points are made of stainless steel.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method of connecting a mandrel of a hydraulic fracturing plug to another mandrel, comprising:

providing the mandrel of the hydraulic fracturing plug with a set of shear pins;

inserting a mating collar of the other mandrel over the shear pins of the hydraulic fracturing plug;

rotating one or more of the mating collar of the other mandrel and the mandrel of the hydraulic fracturing plug such that the shear pins rotate toward an end position of a pin track of the other mandrel; and inserting a master pin through at least a portion of the mating collar of the other mandrel and the mandrel of the hydraulic fracturing plug such that the master pin precludes rotation between the mating collar of the other mandrel and the mandrel of the hydraulic fracturing plug.

2. The method according to claim 1, wherein the inserting the master pin further comprises rotating the master pin.

3. The method according to claim 1, further comprising:

greasing the master pin prior to inserting the mating collar of the other mandrel over the shear pins of the hydraulic fracturing plug.

4. The method according to claim 1, further comprising gripping the hydraulic fracturing plug to prevent rotation.

5. The method of claim 1 wherein the other mandrel is a mandrel of a drill string or a wireline adaptor kit.

6. A hydraulic fracturing plug for use in a wellbore, comprising:

a body including a gripping surface;

a collar that is non-releasable from the fracturing plug when used in the wellbore, the collar further including a set of shear pins adapted to connect the collar to a mandrel; and the collar further including a master pin hole adapted to receive a master pin to prevent rotational movement between the collar and the mandrel.

7. The hydraulic fracturing plug according to claim 6, wherein the collar further includes an edged surface adapted to intersect with a mating surface of the mandrel.

8. The hydraulic fracturing plug according to claim 7, wherein the set of shear pins is configured from stainless steel.

9. The hydraulic fracturing plug according to claim 6, wherein the mandrel includes a track corresponding to each of the set of shear pins; and a master pin adapted to prevent rotational movement between the collar of the hydraulic fracturing plug and the mandrel.

10. The hydraulic fracturing plug according to claim 9, wherein the track in the mandrel of has a first section and a second section.

11. The hydraulic fracturing plug according to claim 10, wherein the first section is perpendicular to the second section.

12. The hydraulic fracturing plug according to claim 9, further comprising:

an edged surface on at least a portion of the collar; and a mating surface on the mandrel, wherein the mating surface on the mandrel is configured to interface with the edged surface on a portion of the collar.

13. The hydraulic fracturing plug according to claim 6, wherein the set of shear pins is a set of five pins.

14. The hydraulic fracturing plug according to claim 13, wherein the shear pins are equidistantly placed around a periphery of the collar.

15. The hydraulic fracturing plug according to claim 6, wherein the gripping surface has a set of contact points to connect the hydraulic fracturing plug to an interior surface of a casing section.

16. The hydraulic fracturing plug according to claim 15, wherein the set of contact points are made of stainless steel.

17. The method of claim 6 wherein the mandrel is a mandrel of a drill string or a wireline adaptor kit.

18. A method of connecting a mandrel of a hydraulic fracturing plug to another mandrel, wherein the mandrel of the hydraulic fracturing plug includes a plurality of shear pins and the other mandrel includes a corresponding plurality of pin tracks for receiving the shear pins, wherein the method comprises:

inserting the other mandrel over the shear pins of the mandrel of the hydraulic fracturing plug;

rotating one or more of the other mandrel and the mandrel of the hydraulic fracturing plug such that the shear pins rotate toward an end position of the corresponding pin tracks of the other mandrel; and using a master pin to preclude rotation between the other mandrel and the mandrel of the hydraulic fracturing plug.

19. The method of claim 18 wherein one or more of the plurality of pin tracks are L-shaped and include a first section and a second section, where the second section includes the end position.

20. The method of claim 18 wherein the master pin is a preloaded spring pin.

21. The method of claim 18 wherein the other mandrel is a mandrel of a drill string or a wireline adaptor kit.

22. A combination, comprising:

a fracturing plug for use in a wellbore, wherein the fracturing plug includes a collar that is non-releasable from the fracturing plug when used in the wellbore and wherein the collar includes a plurality of shear pins;

a mandrel, wherein the mandrel includes a plurality of shear pin tracks corresponding to the plurality of shear pins;

the fracturing plug attached to the mandrel at least by the plurality of shear pins positioned in their corresponding shear pin tracks on the mandrel; and a master pin adapted to preclude rotational movement between the collar and the mandrel.

23. The combination of claim 22 wherein at least one of the plurality of pin tracks is L-shaped and includes a first section and a second section, where the second section includes an end position.

24. The combination of claim 23 wherein at least one of the plurality of shear pins is located in the end position of the corresponding plurality of pin tracks.

25. The combination of claim 24 wherein the master pin is adapted to preclude movement of the plurality of shear pins from their location in their corresponding plurality of pin tracks.

26. The combination of claim 22 wherein the mandrel is a mandrel of a drill string or a wireline adaptor kit.

27. An arrangement, comprising:

a hydraulic fracturing plug for use in a wellbore, wherein the fracturing plug is configured with a gripping surface and a collar that is non-releasable from the fracturing plug when used in the wellbore;

a set of shear pins placed at least partially around the collar;

a mandrel having a set of tracks wherein a corresponding one of the set of shear pins is configured to be captured by a corresponding one of the set of tracks; and a master-pin connecting the mandrel to the hydraulic fracturing plug.

28. The arrangement of claim 27, wherein each of the corresponding one of the set of tracks has a first section and a second section.

29. The arrangement of claim 28, wherein the first section is perpendicular to the second section.

30. The arrangement of claim 29, further comprising:

an edged surface on at least a portion of the collar of the hydraulic fracturing plug; and a mating surface for the mandrel, the mating surface for the mandrel configured to interface with the edged surface of the hydraulic fracturing plug.

31. The arrangement of claim 27 wherein the mandrel is a mandrel of a drill string or a wireline adaptor kit.

32. A plug and mandrel combination, comprising:

a hydraulic fracturing plug configured with a gripping surface and a collar;

a set of shear pins placed at least partially around the collar;

a mandrel having a set of tracks wherein a corresponding one of the set of shear pins is configured to be captured by a corresponding one of the set of tracks, wherein at least one of the set of tracks has a first section and a second section, and wherein the first section is perpendicular to the second section.

33. The plug and mandrel combination of claim 32 further comprising a master-pin for retarding rotational movement between the plug and the madrel.

* * * * *